US007347323B2

(12) United States Patent
Kim

(10) Patent No.: US 7,347,323 B2
(45) Date of Patent: Mar. 25, 2008

(54) BOXED AND SECURED NECKTIE PACKAGE

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 459 days.

(21) Appl. No.: 10/707,179

(22) Filed: Nov. 25, 2003

(65) Prior Publication Data

US 2005/0109644 A1 May 26, 2005

(51) Int. Cl.
*B65D 85/18* (2006.01)

(52) U.S. Cl. ..... 206/278; 206/293

(58) Field of Classification Search ..... 206/293, 206/278, 8; 211/85.3

See application file for complete search history.

(56) References Cited

U.S. PATENT DOCUMENTS

| | | | | | |
|---|---|---|---|---|---|
| 386,807 | A | * | 7/1888 | Fleisch | 206/748 |
| 690,864 | A | * | 1/1902 | Louder | 206/292 |
| 766,242 | A | * | 8/1904 | Gordon | 206/293 |
| 1,501,249 | A | * | 7/1924 | Sulentic | 29/215 |
| 1,578,807 | A | * | 3/1926 | Crossman | 24/3.5 |
| 1,662,039 | A | * | 3/1928 | Heynen | 206/747 |
| 1,677,146 | A | * | 7/1928 | Lobner | 206/278 |
| 1,878,400 | A | * | 9/1932 | Irschik | 38/73 |
| 2,014,822 | A | * | 9/1935 | Trachtenberg | 206/750 |
| 2,057,838 | A | * | 10/1936 | Levy | 206/297 |
| 2,129,905 | A | * | 9/1938 | Bracken | 211/124 |
| 3,125,215 | A | * | 3/1964 | Kulka | 206/53 |
| 4,134,628 | A | | 1/1979 | Mann | |
| 4,779,720 | A | | 10/1988 | Mandelbaum | |
| 4,842,131 | A | | 6/1989 | Mandelbaum | |
| 5,014,830 | A | * | 5/1991 | Seynhaeve | 190/36 |
| 5,052,083 | A | | 10/1991 | Hammer | |
| 5,181,670 | A | | 1/1993 | Eaton et al. | |
| 5,197,661 | A | * | 3/1993 | Sanchez | 229/162.4 |
| 5,353,438 | A | | 10/1994 | Voiles | |
| 5,383,595 | A | * | 1/1995 | Hallam | 229/4.5 |
| 5,560,483 | A | * | 10/1996 | Sequin | 206/278 |
| 5,571,218 | A | | 11/1996 | Caniglia | |
| 5,699,904 | A | * | 12/1997 | Ikemoto | 206/296 |
| 5,762,191 | A | | 6/1998 | Etzion et al. | |
| 5,915,547 | A | | 6/1999 | Chen | |
| 6,050,403 | A | | 4/2000 | Drancy | |
| 6,182,292 | B1 | | 2/2001 | Knoll | |
| 6,422,388 | B1 | * | 7/2002 | McCahey | 206/457 |

* cited by examiner

*Primary Examiner*—Tri M. Mai
(74) *Attorney, Agent, or Firm*—Darby & Darby P.C.

(57) ABSTRACT

A package and packaging methods for retaining a necktie within a box serving as both a display fixture and a packaging container for the enclosed necktie. A member, affixed into the box at at least two spaced locations, is configured to secure the necktie in a rolled, folded, or folded and rolled position within the box. The necktie is positioned to cover the member, wherein the member retains the necktie and prevents its free separation from the package.

9 Claims, 6 Drawing Sheets

BOXED AND SECURED NECKTIE PACKAGE

FIELD OF THE INVENTION

The present invention relates to a display and packaging apparatus for retaining a necktie.

BACKGROUND OF THE INVENTION

Neckties are typically displayed on horizontal racks in a display case, or on a counter top. On occasion, particular neckties are showcased in decorative containers which can be placed on the counter tops of display cases, near cash registers, or at other locations throughout a vendor's store. Several forms for individually packaging and displaying neckties are known.

Packages for neckties (e.g., a single necktie, multiple neckties or neckties with shirts) have been fabricated in various forms. Such containers can assist in the display of neckties to consumers. These containers range from storing multiple neckties lengthwise in a single removable-top cardboard box to storing an individual necktie in its own box. Regarding the latter arrangement, the necktie is usually folded lengthwise along its center and laid flat within the box. This arrangement is common of all prior-art necktie packaging containers and can be troublesome. Customers may remove neckties from their respective boxes in order to try on or show to a friend. When removed, these neckties are not always placed back in the correct box, may be left lying loose on counter-tops, or relocated to a remote place within the store.

The removal of neckties from their boxes can be problematic because pricing and product information is typically on the box in lieu of the tie. Misplaced neckties can lead to inaccurate pricing and consumer confusion. Additionally, when several neckties are disjoined from their respective boxes the task of rejoining each necktie in its correct box can be tedious and time consuming, requiring additional labor and expense on the part of the vendor.

While individually packaging and displaying neckties can provide an eye-catching way of attracting consumers to the product, no particular structure is provided for securing or mounting the necktie therein, preventing its shift within the box, its ready removal from the box, or its separation from pricing/product information on the box. The present invention addresses these and other needs.

SUMMARY OF THE INVENTION

The present invention concerns a package and packaging methods for retaining a necktie within a box serving as both a display fixture and a packaging container for the enclosed necktie. A member, affixed into the box at at least two spaced locations, is configured to secure the necktie in a rolled, folded, or folded and rolled position within the box. The necktie is positioned to cover the member, which is an elastic member in a preferred embodiment. The package provides an attractive way of displaying individual neckties to consumers, eliminates the need for additional packaging materials or labor associated with the purchase of the necktie, and retains the necktie, preventing its free separation from the package. Additionally, neckties securely retained in a package according to the present invention are less likely to wrinkle or crease due to free movement within the box.

These and further aspects, features and advantages of the present invention will become more apparent from the following description when taken in connection with the accompanying drawings which show, for purposes of illustration only, several embodiments of the present invention.

DETAILED DESCRIPTION OF THE PREFERRED EMBODIMENTS

Figure 1:
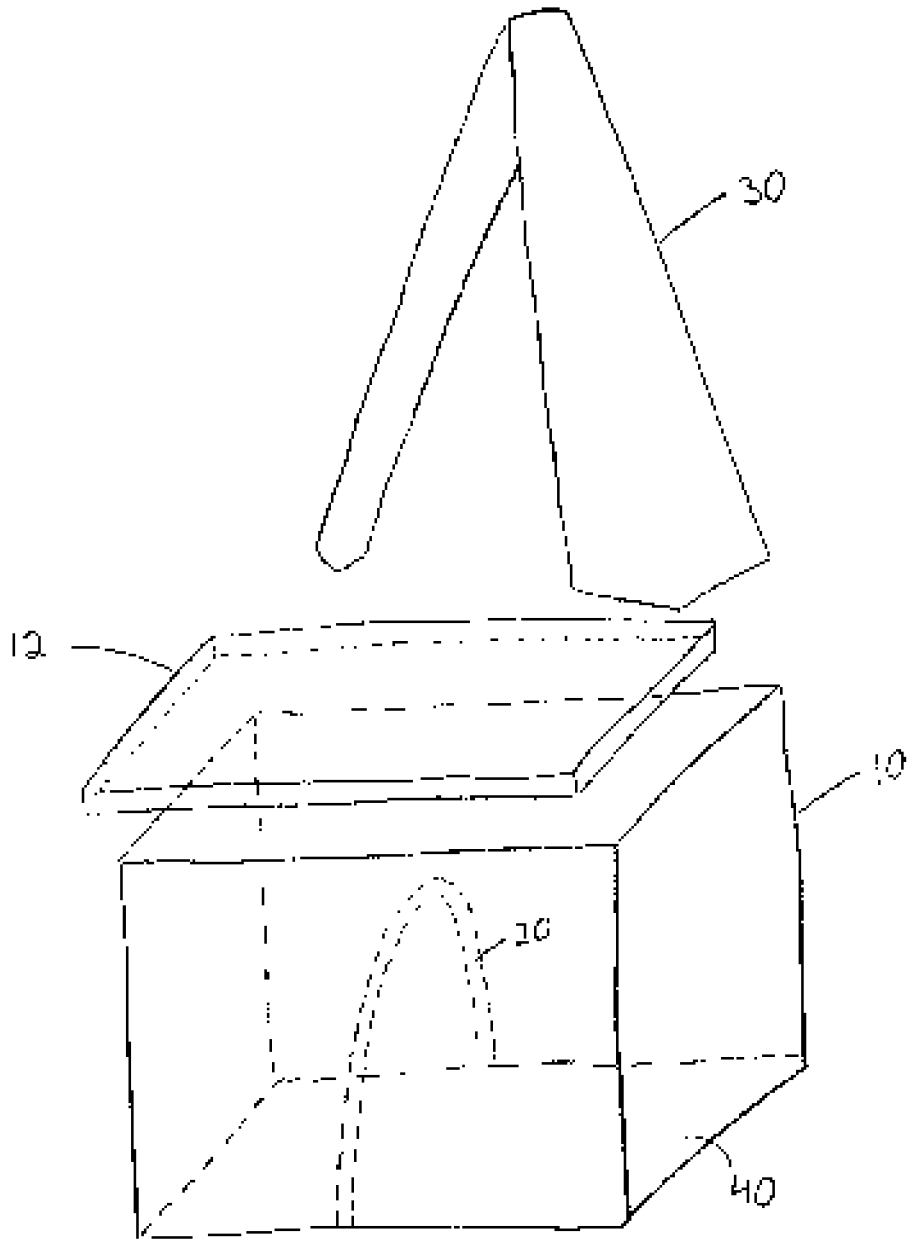
FIG. 1 is a front perspective view of a preferred embodiment of a display and packaging apparatus in spaced relation to a necktie.

A necktie display and packaging structure of a preferred embodiment of the present invention is shown in FIG. 1 in which a box 10 including a movable top portion 12 is provided for retainably displaying a necktie 30. A member 20 is affixed into box 10 at at least two spaced locations within the box. Member 20 can be formed from a number of different materials having elastic properties, such as lycra, spandex or rubber. In alternative arrangements, member 20 is made of a material that can be plastically deformed so as to retain the clothing (such as necktie 30) and can be a plastic or, more preferably, a plastic coated metal (e.g. a "twist tie").

While member 20 is shown affixed at an inner, bottom-edge of box 10, such as along base 40, the location of member 20 within box 10 is not critical and one of ordinary skill in the art can appreciate that member 20 can be affixed at various positions within the box without deviating from the spirit of the present invention. Likewise, member 20 may be integrally formed with box 10 or alternatively composed of any number of suitable elastic, flexible or composite materials and bonded or affixed to box 10. Additionally, while top portion 12 is shown fully removable, the top could be hinged to the box.

Figure 2A:
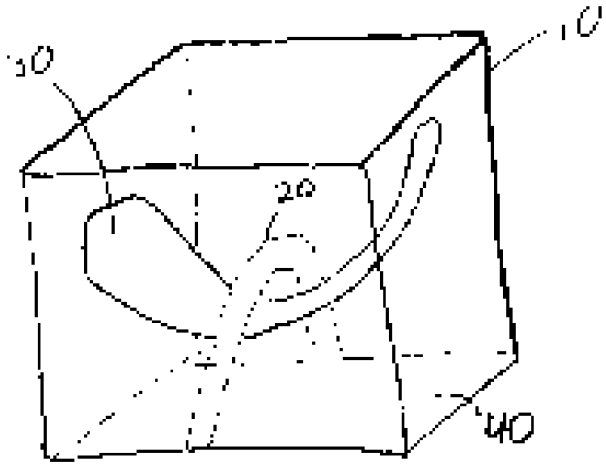
FIGS. 2(*a*), (*b*) and (*c*) are front perspective views of a necktie being retained by the display and packaging apparatus of FIG. 1.
Figure 2B:
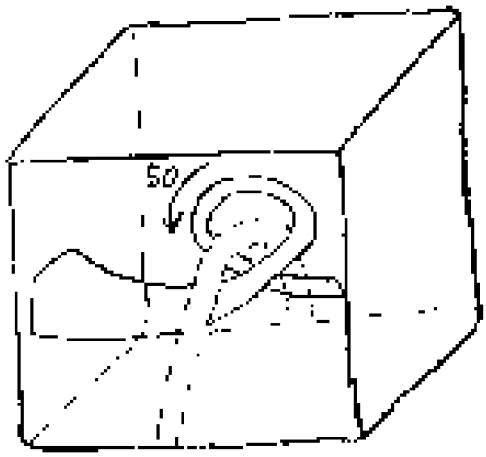
Figure 2C:
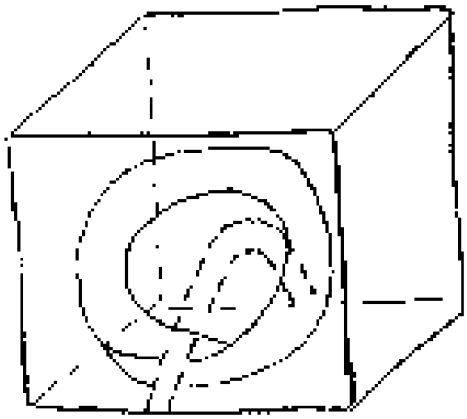

As best shown in FIG. 2, member 20 is operable to secure necktie 30 in a rolled, folded, or folded and rolled position within box 10. Securing necktie 30 with box 10 can be achieved in several different ways utilizing member 20. Referring to FIG. 2(*a*), in a preferred mode, a user can slightly stretch member 20 upward, creating an opening between member 20 and base 40 in which necktie 30 can be inserted therethrough. Necktie 30 is passed under member 20 to a position where a portion of necktie 30 extends from each side of member 20. In this position, necktie 30 is disposed between member 20 and base 40 of box 10, preferably in an unfurled state. Next, referring to FIG. 2(*b*), necktie 30 can be rolled or folded in direction 50 (about member 20) until a portion of necktie 30 has partially or wholly covered member 20. Referring to FIG. 2(*c*), necktie 30 can be rolled or folded several times in the manner described above, and upon completion necktie 30 is completely disposed in box 10 and retained thereto by member 20. While necktie 30 is shown rolled in direction 50, the direction is not critical to the spirit of the invention and a user may roll or fold necktie 30 in the opposite direction about member 20 resulting in the same necktie-retaining effect.

Figure 3A:
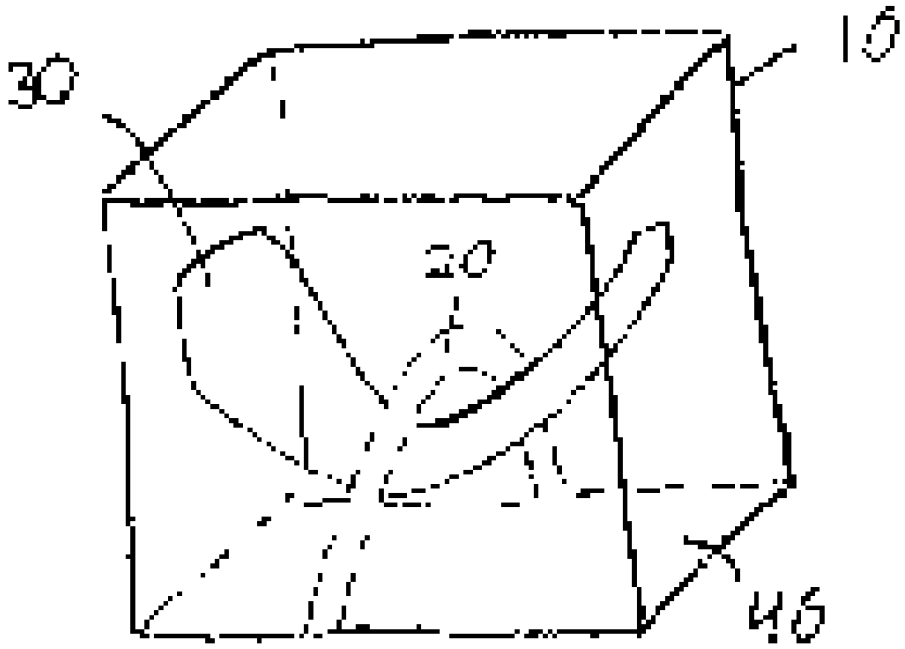
FIGS. 3(*a*) and (*b*) are front perspective views of an alternative arrangement of a necktie being retained by the display and packaging apparatus of FIG. 1.
Figure 3B:
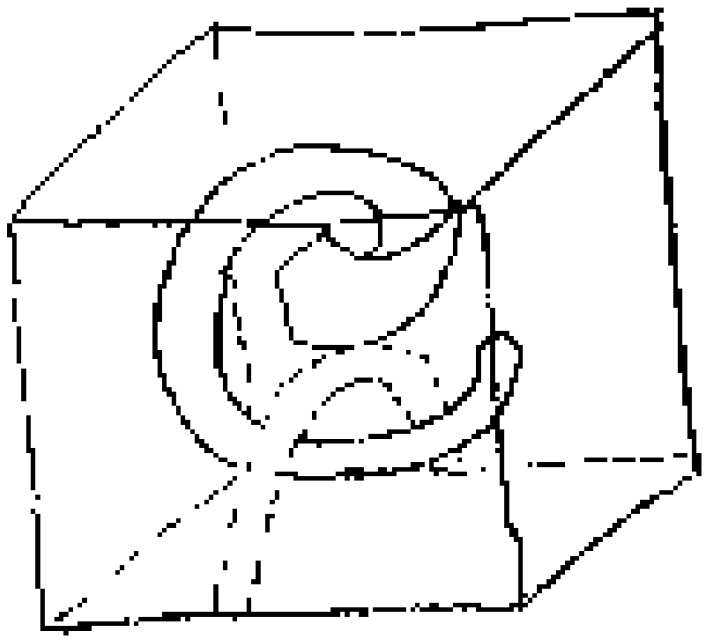

Referring to FIGS. 3(*a*) and 3(*b*), according to an alternative mode, once initially placed between member 20 and base 40 of box 10, a portion of necktie 30 may be rolled or folded about itself in a position that does not include member 20 (see FIG. 3(*b*)). Of course, necktie 30 can be rolled or folded, in part, prior to being placed between member 20 and base 40.

Regardless of whether the necktie is wrapped around member 20 once, as illustrated in FIG. 3(*b*), or several times, as illustrated in FIG. 2(*c*), it is desirable that member 20 is wholly contained interiorly of the box and is not visible exteriorly of the box once it is retained therein. This can be achieved by covering member 20 with a portion of necktie 30 so that the member is concealed when the top 12 is moved.

Referring to FIGS. 2 and 3, the present embodiment provides a package for retaining necktie 30 within box 10 wherein member 20 prevents free separation of necktie 30 and box 10. When it is desired to detachably remove necktie 30, it can be unwound or unfolded from member 20. Thus, the present invention overcomes the problems associated with the prior art packaging and display apparatuses discussed above by utilizing member 20 to prevent free separation of necktie 30 from box 10 while allowing necktie 30 to be conveniently stored and displayed in a rolled, folded, or folded and rolled position. Additional clips or wire/plastic ties may be utilized to further secure particular portions of necktie 30 when necessary. Furthermore, these clips and/or wire/plastic ties can be applied to necktie 30 prior to its engagement with member 20 or sometime thereafter.

Figure 4:
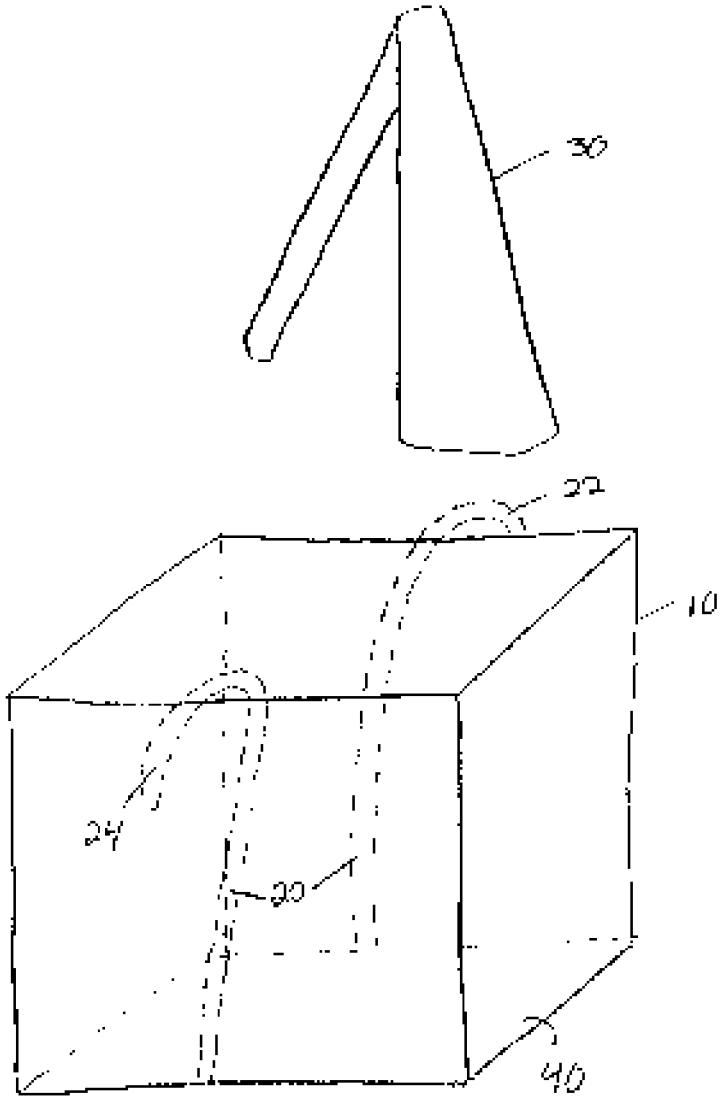
FIG. 4 is a front perspective view of a second embodiment of a display and packaging apparatus shown in spaced relation to a necktie.

Referring to FIG. 4, according to a second embodiment of the present invention, a box 10 including a movable top portion 12 is provided for retainably displaying a necktie 30. A member 20 including at least two operably extending free ends 22, 24 is affixed into box 10 at at least two spaced locations within the box. As mentioned above, member 20 can be formed from a number of different materials, preferably those having elastic properties such as lycra, spandex or rubber.

Figure 5A:
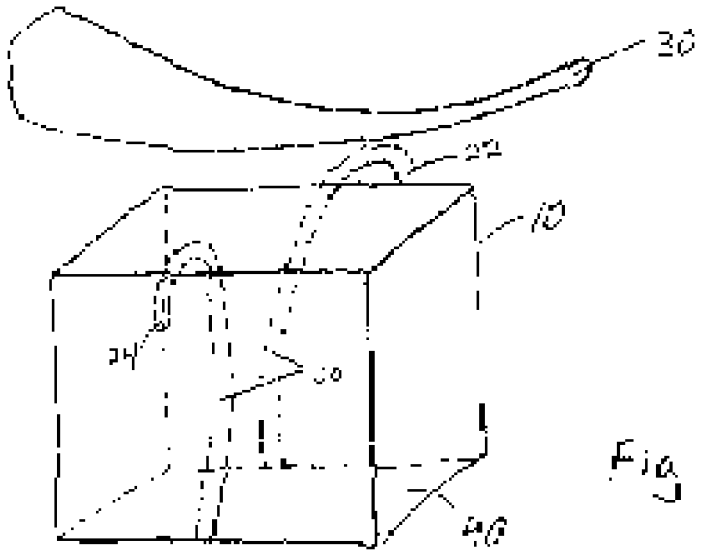
FIGS. 5(*a*), (*b*) and (*c*) are front perspective views of the necktie being retained by the display and packaging apparatus of FIG. 4.
Figure 5B:
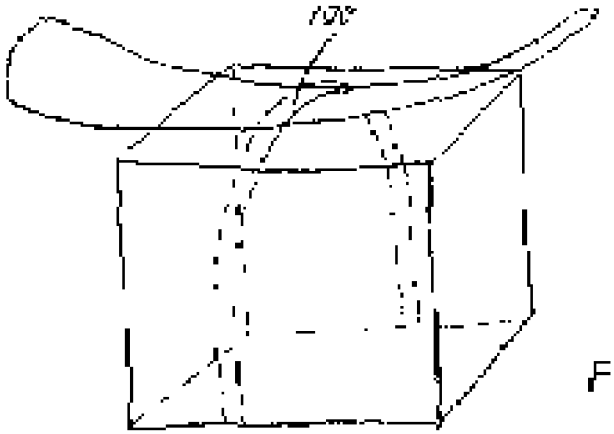
Figure 5C:
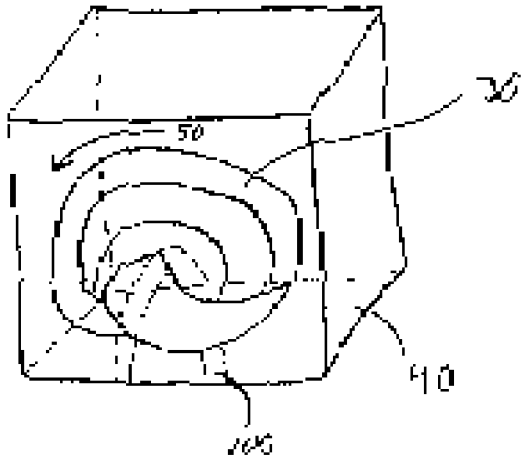

As illustrated in FIG. 5, member 20 is configured to secure necktie 30 in a rolled, folded, or folded and rolled position within box 10. Referring to FIG. 5(*a*), operably extending free ends 22, 24 can be positioned to rest exteriorly of box 10. Next, necktie 30 is placed lengthwise above the open-end of box 10. With reference to FIG. 5(*b*), operably extending free ends 22, 24 can be positioned about necktie 30 and tied, twisted or bonded to form a single, continuous conjoined member 100. In this position, necktie 30 is disposed between member 100 and base 40 of box 10. Next, as illustrated in FIG. 5(*c*), necktie 30 can be rolled or folded in the direction 50 (about member 100) until a portion of necktie 30 has partially or wholly covered member 100. Necktie 30 can be rolled or folded several times in the manner described above, and upon completion necktie 30 is completely disposed in box 10 and retained thereto by member 100.

Figure 6:
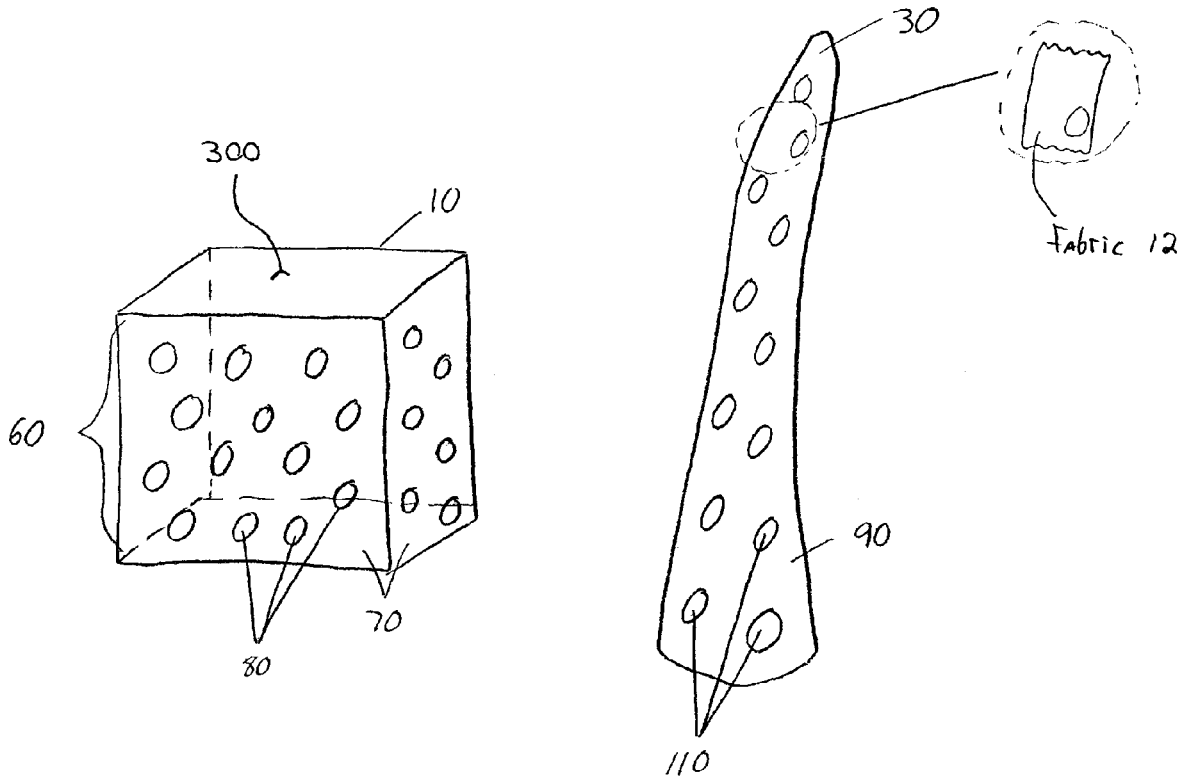
FIG. 6 is a front perspective view of a display and packaging apparatus shown in spaced relation to a necktie and having additional, coordinating features.

Referring to FIG. 6, box 10 is square shaped and includes an outer fabric layer 60 of a first color 70 and a first pattern 80 that coordinate with at least the color 90 or pattern 110 on necktie 30. Preferably, fabric layer 60 of box 10 is selected to coordinate with fabric 120 of necktie 30 retained therein. Box 10 also includes an interior layer of fabric 300 that can be selected to coordinate with necktie 30.

While the invention has been described with reference to several embodiments thereof, the invention is more broadly defined and limited only by the recitations in the claims appended hereto and their legal equivalents.

The invention claimed is:

1. A packaged necktie, comprising:

a box including a bottom portion and a movable top portion;

a necktie arranged within the box such that it includes a rolled end portion, the rolled end portion being a circuitously rolled portion at one end of the necktie; and a continuous elastic member affixed to the bottom portion of the box and configured to retain the rolled necktie so as to normally prevent separation of the necktie from the box, the elastic member being mounted to the box at first and second spaced locations within the box and being disposed so as to retain the necktie by overlying a first portion of the rolled necktie while being concealed by a second portion of the rolled necktie such that the elastic member is concealed from view within the box, wherein the first and second portions are different from the rolled end portion.

2. A package according to claim 1, wherein the elastic member is wholly contained interiorly of the box.

3. An improved packaging arrangement according to claim 1, wherein the elastic member has a length between the spaced locations sufficient to receive an unfurled width of the necktie when caustically stretched.

4. A package according to claim 1, wherein the first and second spaced locations are on a center line of the box.

5. A package according to claim 1, wherein the box includes at least one of a first color and a first pattern that coordinate with at least one of a second color and a second pattern included on the necktie.

6. A package according to claim 1, wherein the box includes at least one of an exterior and an interior layer of fabric that is selected to coordinate with the necktie retained therein.

7. A package according to claim 1, wherein the first and second portions are portions of the tie between its two opposing ends and the rolled end portion is spaced from the elastic member.

8. A package according to claim 1, wherein the rolled end portion is preformed prior to the necktie being looped around the elastic member.

9. A packaged necktie, comprising:

a box including a bottom portion and a movable top portion and two side wall portions;

a necktie arranged within the box such that it includes a rolled end portion, the rolled end portion being a circuitously rolled portion at one end of the necktie; and an elastic member having a first segment and a second segment that is discontinuous relative to the first segment, each of which is affixed to the bottom portion of the box and configured to retain the rolled necktie, when the first and second segments are attached to one another to form a continuous elastic member, so as to normally prevent separation of the necktie from the box, the first segment of the elastic member being mounted to the box at a first location and the second segment being mounted to the box at a second spaced location within the box, each of the first and second segments being of a length and having a free end that can be placed to rest exteriorly to the box, the continuous elastic member being disposed so as to retain the necktie by overlying a first portion of the rolled necktie while being concealed by a second portion of the rolled necktie such that the elastic member is concealed from view within the box, wherein the first and second portions are different from the rolled end portion.

* * * * *